US006085471A

United States Patent [19]

Axon

[11] Patent Number: 6,085,471

[45] **Date of Patent: *Jul. 11, 2000**

[54] EARTHQUAKE SHOCK DAMPER FOR ROADWAY PILLARS

[76] Inventor: Micheal G. Axon, 1422 S. Lake Stevens Rd., Lake Stevens, Wash. 98258

[ * ] Notice: This patent is subject to a terminal disclaimer.

[21] Appl. No.: 08/914,418

[22] Filed: Aug. 19, 1997

Related U.S. Application Data

[63] Continuation-in-part of application No. 08/553,890, Nov. 6, 1995, Pat. No. 5,657,588, which is a continuation-in-part of application No. 08/336,736, Nov. 7, 1994, abandoned.

[51] Int. Cl.[7] ..... E04H 9/02; E04B 1/36; E04B 1/98

[52] U.S. Cl. ..... 52/167.4; 52/167.1; 52/167.7; 52/167.8; 52/167.9

[58] Field of Search ..... 52/167.1, 167.4, 52/167.7, 167.8, 167.9

[56] References Cited

U.S. PATENT DOCUMENTS 468,186 2/1892 Beardsley .
3,110,464 11/1963 Baratoff et al. .
3,606,704 9/1971 Denton ..... 52/167.8
3,794,277 2/1974 Smedley et al. ..... 52/167.4 X
3,796,017 3/1974 Meckler ..... 52/167.3 X
3,797,183 3/1974 Kobayashi et al. ..... 52/167.4
4,498,266 2/1985 Perreton ..... 52/405.4
4,720,882 1/1988 Gallo ..... 52/167.4 X
4,860,507 8/1989 Garza-Tamez ..... 52/167.4
4,860,882 8/1989 Maeda et al. .
5,386,671 2/1995 Hu et al. ..... 52/167.3

*Primary Examiner*—Robert Canfield
*Attorney, Agent, or Firm*—Todd N. Hathaway

[57] ABSTRACT

An earthquake shock damper particularly suitable for use in load bearing columns or pillars, such as columns or pillars which are used to support bridges, elevated highways, or large structures. The damper improves structure's earthquake resistance, by reducing the magnitude of damage to the structure, by isolating and lowering the earthquake frequencies transmitted to a structure, by reducing the forces and accelerations imposed on the structure, and by reducing the horizontal and vertical displacement inflicted on the structure. This damper consists of a female receptacle, a male plug set within the female receptacle but generally separated from the female receptacle by a relativity flexible shock insert completely or partially filling the gap between the male plug and the female receptacle.

18 Claims, 6 Drawing Sheets

EARTHQUAKE SHOCK DAMPER FOR ROADWAY PILLARS

This is a continuation-in-part of application Ser. No. 08/553,890 filed on Nov. 6, 1995, now U.S. Pat. No. 5,657,588 and 08/336,736 filed Nov. 7, 1994, now abandoned.

FIELD OF THE INVENTION

This invention relates to earthquake shock dampers, and more particularly to earthquake shock dampers suitable for use in load bearing columns or pillars used to support bridges, elevated highways, or other large structures.

BACKGROUND OF THE INVENTION

Bridges, elevated highways, and other large structures supported on load bearing columns are often constructed in areas where earthquake protection for the structure is required. The structural integrity of these structures is highly dependent on the capacity of the load bearing columns to survive the stresses imposed during an earthquake. A structure may be able to withstand the loss of one or more load bearing columns, however, each failure increases the load on the rest of the structure, and makes it more likely that the entire structure will fail. Thus, it is critical to prevent a load bearing column from failing under the forces and moments generated within the column during an earthquake. These loads include horizontal, and vertical forces as well as twisting and bending moments.

The development of earthquake protection for buildings has heretofore focused primarily on methods to isolate the structure from the foundation. Base isolation is the name given to these methods. A building supported by a base isolation system will "float" on its foundation. Additionally, damping systems are also employed to reduce any motion the structure may develop. See generally U.S. Pat. No. 3,606,704 (Denton); U.S. Pat. No. 3,794,227(Smedley et. al.); U.S. Pat. No. 4,860,507 (Garza-Tamaz); U.S. Pat. No. 5,386,671 (Hu et. al). Base isolation has proven to be an effective method of protecting buildings from earthquake loads. Buildings using base isolation are supported by a foundation with a relatively large area (foot print) with the typical building having a square or rectangular shape and four external load bearing walls. Thus, the earthquake forces are spread over a large area. Additionally, a building, even one on a base isolation system, will be stable under most loads. A building will only become unstable when the building's center of gravity (approximately the building's geometric center) is moved so that the center of gravity lies outside the vertical plane of one of the exterior load bearing walls. If a building becomes unstable, then the building will tip over; however, the typical building would be unlikely to be able to survive the loading which would generate the forces necessary to move a building's center of gravity the distance necessary to cause the building to topple.

Despite the progress in developing earthquake dampers for buildings, there have not been any earthquake dampers developed for bridges, elevated highways, or similar large structures which has proven effective for use in the load bearing column itself. Additionally, typical construction methods use either a single column or a single row of columns to support a cross-beam or pier head. This cross-beam or pier head supports the rest of the structure. Some earthquake protection systems have been developed which act as a form of base isolation. These devices have been placed between the cross-beam or pier head and the girder structure of the bridge. See U.S. Pat. No. 3,986,222 (Miyazaki et. al.) And U.S. Pat. No. 4,720,882 (Gallo). Earthquake protection systems located between the beam or pier and the girder structure may provide some protection for the girder structure, however, the load bearing column and the cross-beam or pier head, critical structural members located between the foundation and the shock dampers, are left unprotected.

Designing and constructing earthquake protection for these columns is more difficult than designing and constructing protection for a building. This difficulty arises because of the following differences between a column and a structure: 1) the earthquake loads in a building are spread over a large number of load bearing members compared to a small number for a bridge, 2) the earthquake loads in a building are spread over a relativity large area compared to the small cross-section of a column, 3) a structure has a large range of stability compared to a column, and 4) a structure can "float" on a base isolation system installed between the building and its foundation, typical columns must be fixed to their foundation for proper support.

Earthquake protection for load bearing columns currently consists of designing the column to withstand all the forces and moments generated during an earthquake. Designing the column to withstand earthquake forces and moments has several drawbacks. The principal problems with this approach are a) added cost of building the stronger pillar, and b) added cost of designing and building the full structure to withstand earthquake loads or cost of placing earthquake dampers or isolators between the cross-beam or pier head and the rest of the structure. Also, the earthquake dampers/isolators which have been developed for use between the cross-beam or pier head and the structure provide earthquake load damping primarily only in a single direction, whereas earthquake forces ordinarily develop in multiple directions, e.g., both horizontal and vertical directions. See U.S. Pat. No. 4,720,882(Gallo) and U.S. Pat. No. 3,986,222 (Miyazaki et al).

Unfortunately, recent earthquakes have demonstrated the deficiencies of existing methods of "earthquake proofing" large structures, and consequently have shown the the need to protect load bearing columns from failure during earthquakes. Thus, there is a need for an earthquake damper/isolator which can be used in both new columns and retrofitted into existing columns to protect both the column and supported structure from earthquake forces and moments regardless of direction.

SUMMARY OF THE INVENTION

The present invention has solved the problems cited above and comprises broadly an earthquake shock control system for load bearing pillars/columns. There is a female receptacle with a single opening. A friction rocker rests in a hemispherical indentation centered in the bottom of the female receptacle. There is a male plug formed so as to fit into the opening of the female receptacle and over the friction rocker, leaving gaps between the male plug and both the female receptacle and the top friction rocker. These gaps are typically filled with polyurethane inserts. Attachment means are provided to attach the female receptacle and male plug to the load bearing column or pillar.

DETAILED DESCRIPTION a. Structure

Figure 1:
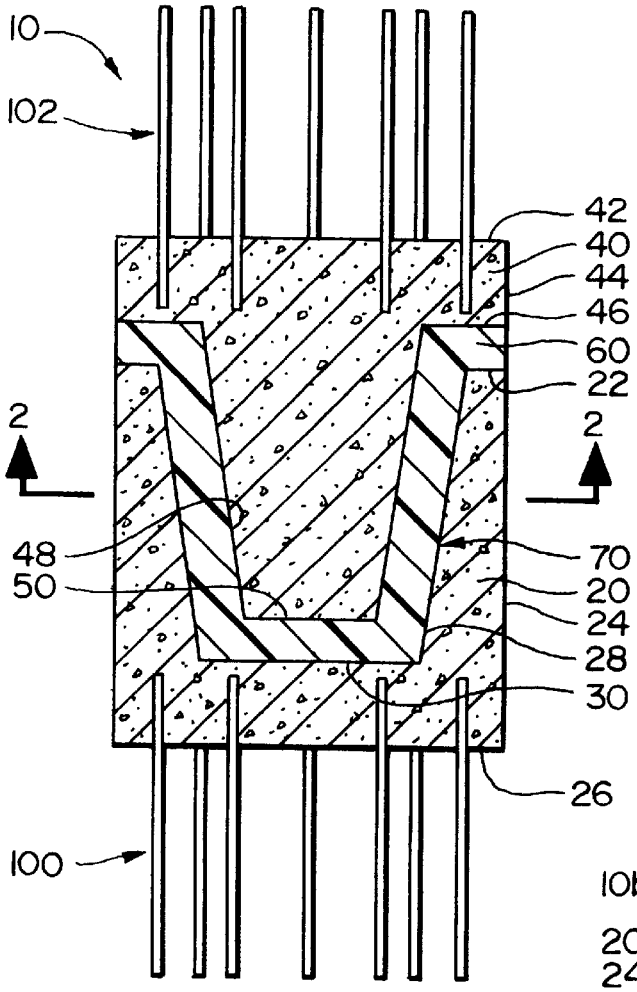
FIG. 1 is a vertical cross-section taken through the earthquake shock damper for roadway pillars in accordance with the present invention, this invention comprising a female receptacle, a male plug residing inside the female receptacle, the male plug being formed such that a space is left between the male plug and the female receptacle, and this space being filled with a shock absorbing insert.

FIG. 1 illustrates an earthquake shock damper 10 in accordance with the present invention. This embodiment of the shock damper is intended for use in columns which are designed to bear comparatively light loads, typically much less than 500 pounds per square inch. The shock damper 10 comprises a female receptacle 20, a male plug 40 which fits inside the female receptacle 20 so as to leave a gap 70, a shock insert 60 which either completely or partially fills the gap 70 between the male plug 40 and the female receptacle 20. A first group of rebar members 100 attached to the female receptacle 20 and a second group of rebar members 102 attached to the male plug 40, these rebar members serve to connect the shock damper 10 to the reinforced concrete column or pillar.

The female receptacle 20 comprises a top edge 22, an outer receptacle surface 24 which joins the top edge 22 to an outer bottom surface 26, and a female conical surface 28 which joins top edge 22 to an inner bottom surface 30. The male plug 40 comprises a top surface 42, an outer plug surface 44 which joins the top surface 42 to a bottom edge 46, a male conical surface 48 which joins the bottom edge 46 to a plug bottom 50. The male plug 40 fits inside the female receptacle leaving a gap 70, such that male plug 40 does not generally touch the female receptacle 20. Preferably completely filling this space between the female receptacle 20 and the male plug 40 is a shock insert 60. In some applications, however, the shock insert 60 will only partially fill the space between the female receptacle 20 and the male plug 40. For example, shock insert 60 might fill the space between the female conical surface 28 of the female receptacle 20 and the male conical surface 48 of the male plug 40. Alternately, shock insert 60 may fill the space between the female conical surface 28 of the female receptacle 20 and the male conical surface 48 of the male plug 40 and the space between the top edge 22 of the female receptacle 20 and the bottom edge 46 of the male plug 40. The selection of the extent of the space filled by the shock insert 60 will depend on the specification for a specific load bearing column, the engineers judgment, and the results of the finite element analysis described below.

It is preferred that the following pairs of surfaces be approximately parallel to each other: a) top surface 42 and bottom surface 26, b) bottom edge 46 and top edge 22, c) male conical surface 48 and female conical surface 28, and d) plug bottom 50 and inner bottom surface 30. These pairs of surfaces are not required to be parallel, however, when these surfaces are parallel the shock insert 60 is more evenly loaded. Additionally, parallel surfaces promote an even horizontal displacement of the male plug 40 with respect to the female receptacle 20 without adding additional moments to the shock damper 10 during an earthquake. There are some applications, however, where the structural engineer may require an uneven loading of the shock insert and the development of moments within shock damper 10 for his particular applications. Additionally, it is preferred for the typical column that the distances between the following pairs of surfaces be approximately equal: a) bottom edge 46 and top edge 22, b) male conical surface 48 and female conical surface, and c) plug bottom 50 and inner bottom surface 30. The equal distance between all the opposing surfaces will give the shock insert 60 an even thickness and promotes even loading of the shock insert 60. There are some applications, however, where the structures specifications may require different pairs of surfaces to have different distances between them. Thus, shock insert 60 could vary in thickness if required for a specific application. The corners where the following surfaces intersect can be sharp, however, it is preferred that the following corners have a radius of between 0.5–1.5 inches: a) top edge 22 and female conical surface 28 b) female conical surface 28 and inner bottom surface 30, c) bottom edge 46 and male conical surface 48, and d) male conical surface 48 and plug bottom 50. The need for and the amount of radius will depend on the material selected for shock insert 60, the load on the shock damper 10, and the amount of horizontal displacement that shock damper 10 is designed to accommodate. The radius for each corner should be large enough to prevent cutting, tearing, or otherwise damaging shock insert 60.

The preferred slope of the female conical surface 28 and the male conical surface 48 may vary depending on the load on the shock damper 10, the material selected for shock insert 60, the amount of horizontal displacement that shock damper 10 is designed to accommodate, and the stiffness of the shock damper 10. An angle of six degrees however, appears to work for most applications. This angle can be optimized for the specific application in the design process discussed below.

A first group of rebar members 100 are attached to the female receptacle 20 and a second group of rebar members 102 are attached to the male plug 40. This attachment may be by any means with sufficient strength for the particular application. Some examples include but are not limited to welding, fastening, or glueing to top surface 42 of male plug 40, or the outer bottom surface 26 of the female receptacle 20, or by casting the female plug 20, and /or the male plug 40 around the rebar members 100 and 102 with these members being inserted a suitable distance into the castings. The number, spacing, grade, material, and size of the rebar would be determined and specified by the structural/bridge engineer, so that the shock damper 10 could be easily incorporated into a reinforced concrete column/pillar supporting the bridge, elevated highway or similar structure.

Figure 2A:
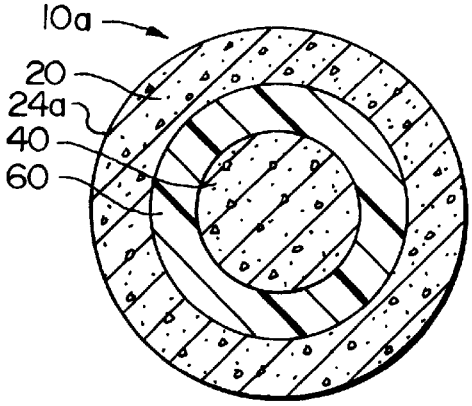
FIGS. 2A and 2B are horizontal cross-sections taken through the earthquake shock damper shown in FIG. 1 at 2—2.

With reference now to FIG. 2A, which is a horizontal cross-section taken at 2—2 through the earthquake shock damper shown in FIG. 1, there is shown the first embodiment of shock damper 10*a* in which the outer surface 24*a* of the female receptacle is formed to have a circular cross-section.

Figure 2B:
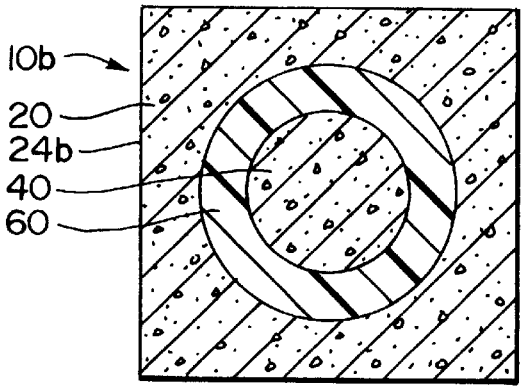

With reference now to FIG. 2B, which is a horizontal cross-section taken through another embodiment of the earthquake shock damper in accordance with the present invention, there is shown an embodiment of shock damper 10*b* in which the outer surface 24*b* of the female receptacle 20 has a square cross-section. The outer plug surface 44 of the male plug 40 and the outer receptacle surface 24 of the female receptacle 20 can, however, be any shape in cross-section. Typically, both outer surface 24 of the female receptacle 20 and the outer surface 44 of the male plug 40 will have the same cross-section, and this cross-section will match that of the column/pillar with which the shock damper 10 is employed.

Figure 3:
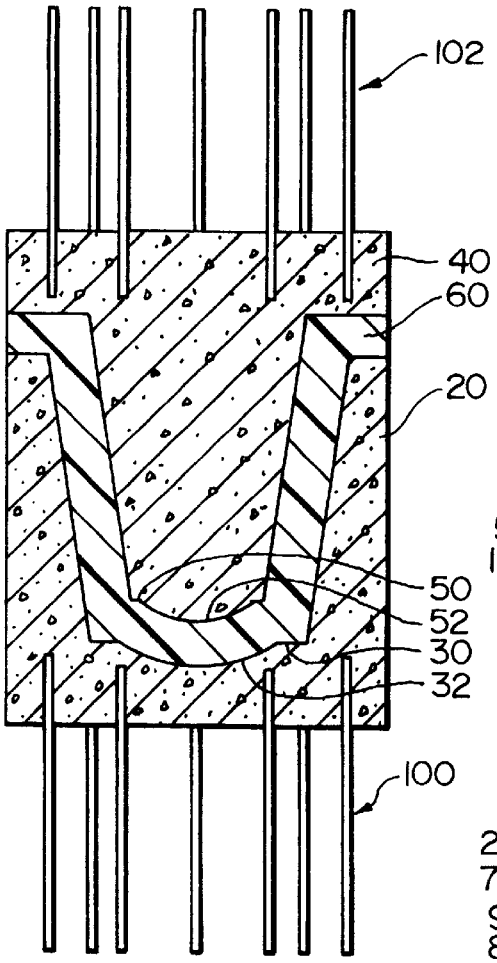
FIG. 3 is a vertical cross-section similar to FIG. 1 taken through an earthquake shock damper in accordance with the present invention, wherein a hemispherically shaped bulge is formed on the bottom of the male plug and a corresponding hemispherical indentation is formed in the inner bottom of the female receptacle.

FIG. 3, shows a horizontal cross-section through an earthquake shock damper which is generally similar to that shown in FIG. 1, but in which there is a concave hemispherical indentation 32 centered in the inner bottom 30 of the female receptacle 20, and a corresponding convex hemispherical bulge 52 centered in the plug bottom 50 of the male plug 40. The radius of the indentation 32 and the radius of the bulge 52 will depend on the amount of realigning force desired by the bridge/structural engineer. These radii are preferably selected so that the distance between the indentation 32 and the bulge 52 remains constant and approximately equal to the distance between the inner bottom surface 30 and plug bottom 50. This even spacing provides for a more even loading of shock insert 60. The distance, however, can be varied to meet the specific design requirements of a particular bridge/structure. The amount of realigning force generated will depend on the material properties of the shock insert 60 and the actual radii selected for the indentation 32 and the bulge 52. Additionally, the same type of realigning force can be created by replacing the concave hemispherical indentation 32 of female receptacle 20 with a convex hemispherical bulge and replacing the convex hemispherical bulge 52 of male plug 40 with a concave hemispherical indentation.

Variations of the shock damper 10 shown in FIG. 3 would include the variations in the shock insert 60 discussed for FIG. 1 above. If shock insert 60 does not fill the space between the indentation 32 of the female receptacle 20 and the bulge 52 of the male plug 40, then the indentation 32 and the bulge 52 should be in contact with each other and have the proper radii to develop the required realigning force. The construction and radius or radii of the bulge 52 would be determined in the same fashion as the radius or radii of the lower end 86 of the friction rocker 80 shown in FIG. 4 and discussed below. Similarly, construction and radius of the indentation 32 would be determined in the same fashion as the radius of the indentation 144 of the friction rocker seat 140 also shown in FIG. 4 and discussed below.

Figure 4:
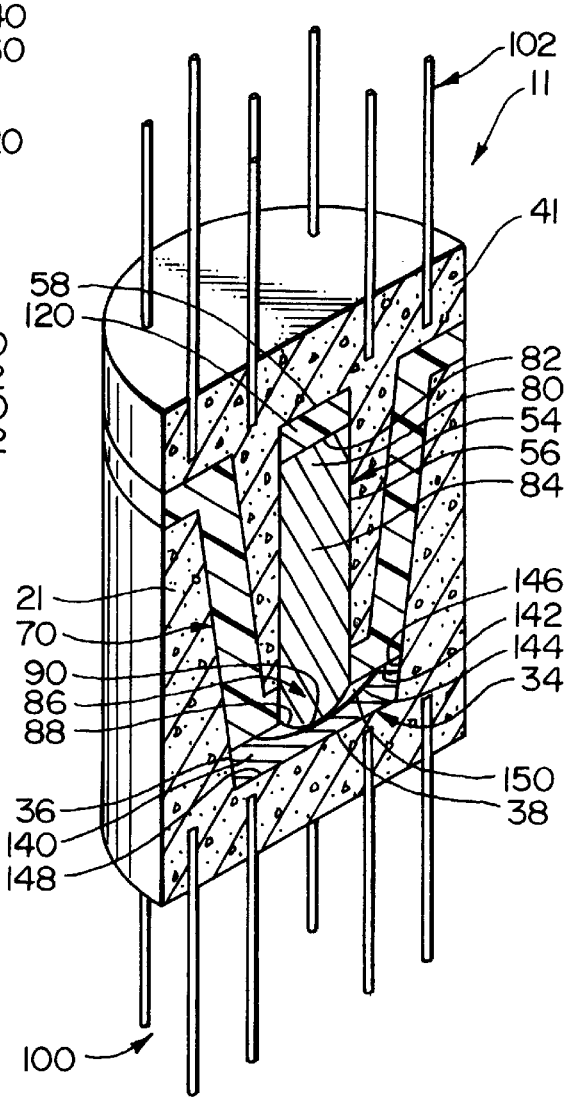
FIG. 4 is a perspective view of a vertical cross-section somewhat similar to FIG. 1 taken through an earthquake shock damper for roadway pillars shown in accordance with the present invention, wherein a friction rocker resides inside the female receptacle, the male plug being formed such that spaces are left between the male plug and both the female receptacle and the upper end portion of the friction rocker, these spaces being filled with shock absorbing inserts.

FIG. 4, in turn, shows a perspective view of a vertical cross-section through the earthquake shock damper generally similar to that shown in FIG. 1, but in which there is a friction rocker 80, a shock plug 120, and a friction rocker seat 140. This embodiment is the generally preferred embodiment for columns/pillars where the load exceeds 500 pounds per square inch. As can be seen in FIG. 4 male plug 41 is modified from the structure which is shown in FIG. 1, and further comprises a cylindrical cavity 54 centered in the plug bottom 50 of the male plug 41. The cylindrical cavity 54 comprises a side wall 56 and an upper end surface 58.

The female receptacle 21 is also modified. The female receptacle 21 further comprised a seat cavity 34. Seat cavity 34 is large enough to accommodate friction rocker seat 140 and placed so that the friction rocker seat 140 will replace both the inner bottom 30 and indentation 32 both of the female receptacle 20. The seat cavity 34 comprises a bottom surface 38 and a side surface 36 which joins the female conical surface 28 to the bottom surface 38. If the friction rocker seat 140 is not used for a particular application then the female receptacle 20 will not be modified as described above.

The friction rocker 80 is slidably inserted in and projects from the lower end of the cylindrical cavity 52 of male plug 41. Friction rocker 80 is generally cylindrical in cross-section and comprises an upper end portion 82, a lower end portion 86, and a stem 84 connecting the upper end portion 82 to the lower end portion 86. The lower end portion 86 comprises a central hemispherically curved bearing surface 90, and an annular hemispherically curved edge surface 88. The hemispherically shaped bearing surface 90 is centered on the lower end portion 86 of the friction rocker 80, and the annular hemispherically curved edge surface 88 joins the hemispherically curved bearing surface 90 to the outer surface of stem 84. There can be a pronounced change in angle at the intersection of the annular hemispherically curved edge surface 88 and the hemispherically curved bearing surface 90, however, it is preferred that this intersection be smooth. Typically, the annular hemispherically curved edge surface 88 and the hemispherically curved bearing surface 90 will have different radii, however, in some applications the radii of both the annular hemispherically curved edge surface 88 and the hemispherically curved bearing surface 90 can be similar.

Alternately, the lower end portion 86 of the friction rocker 80 may be formed from a rocker bearing and a socket. The rocker bearing would be generally spherical in shape. One hemisphere of the bearing would reside in the socket and the hemispherically curved bearing surface would contact and transfer the load from the friction rocker to either the female receptacle 20 or the friction rocker seat 140. The diameters of the rocker bearing and the socket would be designed to minimize the friction developed. Additionally, the radii of these hemispheres would be determined in the same manner as the radii of the edge surface 88 and the hemispherically curved bearing surface 90 both of the lower end portion 86. The method of determining these radii is discussed below.

The cylindrical cavity 52 of the male plug 40 has a large enough diameter to allow the friction rocker 80 to slide vertically within the cylindrical cavity 52 with little or minimal friction. The diameter of cylindrical cavity 52 must be small enough to prevent the fiction rocker 80 from shifting too far off the center within the cylindrical cavity 52, which might otherwise prevent friction rocker 80 from working in conjunction with the surface on which it rests to generate the desired realignment force.

Lying between and completely filling the space between the upper end portion 82 of the friction rocker 80 and the upper end surface 58 of the cylindrical cavity 52 in the male plug 41 is shock plug 120. Shock plug 120 transfers a majority of the load from the male plug 41 to friction rocker 80. Furthermore, shock plug 120 dampens and absorbs the earthquake forces and lowers the frequencies of these forces transmitted from the friction rocker 80 through the shock plug 120 to the male plug 41. Shock plug 120 is preferably made out of the same material as the shock insert 60. Additionally, the shock plug 120 preferably is the same thickness as the shock insert 60. However, differences in both material and thickness between the shock insert 60 and the shock insert 120 may be employed to meet the specifications of a specific structure. The possible materials for making the shock plug 120 are the same as those listed for the shock insert 60.

The friction rocker 80 rests on the friction rocker seat 140. This seat 140 transfers the vertical load imposed on the friction rocker 80 to the female receptacle 21. The friction rocker seat comprises a inner bottom surface 142, a concave hemispherically indentation 144, a side wall 146, and a bottom surface 148. The concave hemispherical indentation 144 is centered in the inner bottom surface 142 and serves essentially the same function as the indentation 32 of the female receptacle 20 described above. Surrounding indentation 144 of the seat 140 is the inner bottom surface 142. In some applications, depending on the radius of indentation 144 and the size of the shock damper 11, the inner bottom surface 142 may not be required or desired. Generally, however, the side wall 146 will connect the inner bottom surface 142 to bottom surface 148. The friction rocker seat 140 can be joined to the female receptacle 21 by any method which is compatible with the materials of both the friction rocker seat 140 and the female receptacle 21, the preferred method being either an interference fit or by placing the friction rocker seat 140 in the mold for the female receptacle 21 prior to casting.

The friction rocker seat 140 is only required for those applications where the local stress imposed by the lower end 86 of friction rocker exceeds the yield stress of the material selected for the female receptacle 20. In the absence of the friction rocker seat 140, friction rocker 80 would then rest on the concave hemispherical indentation 32 of female receptacle 20. Additionally, in some applications requiring only a small realigning force neither concave hemispherical indentation 32 in female receptacle 20 nor indentation 144 of friction rocker seat 140 would be required. In the absence of indentation 144 or indentation 32, the lower end 86 of the friction rocker 80 would then rest directly on either the inner bottom surface 142 of the friction rocker seat 140 or on the inner bottom surface 30 of female receptacle 20 depending on which embodiment is employed.

The radius of the hemispherically curved bearing surface 90 of the lower end 86 of the friction rocker 80 will be approximately the same as the radius of either the indentation 32 of the female receptacle 20 or the indentation 144 of the friction rocker seat 140. The difference in radius between the annular hemispherically curved edge surface 88 of friction rocker 80 and the indentation 144 in the friction rocker seat 140 or the indentation 32 in the female receptacle 20 will generate a side/realigning force according to the following equation:

$$\frac{F_{SR}}{F_P} = \frac{d}{\sqrt{(R_1 - R_2)^2 - d^2}}$$

Where:

$F_{SR}$=the side/realigning force desired from the difference in the two radii.

$F_P$=the vertical load on the column.

d=the horizontal displacement of the male plug 40 with respect to the female receptacle 20.

$R_1$=the radius of the indentation 144 of the friciton rocker seat 140 or indentation 32 of the female receptacle 20.

$R_2$=the radius of the annular hemispherically curved edge surface 88 of the friction rocker 80.

Figure 9A:
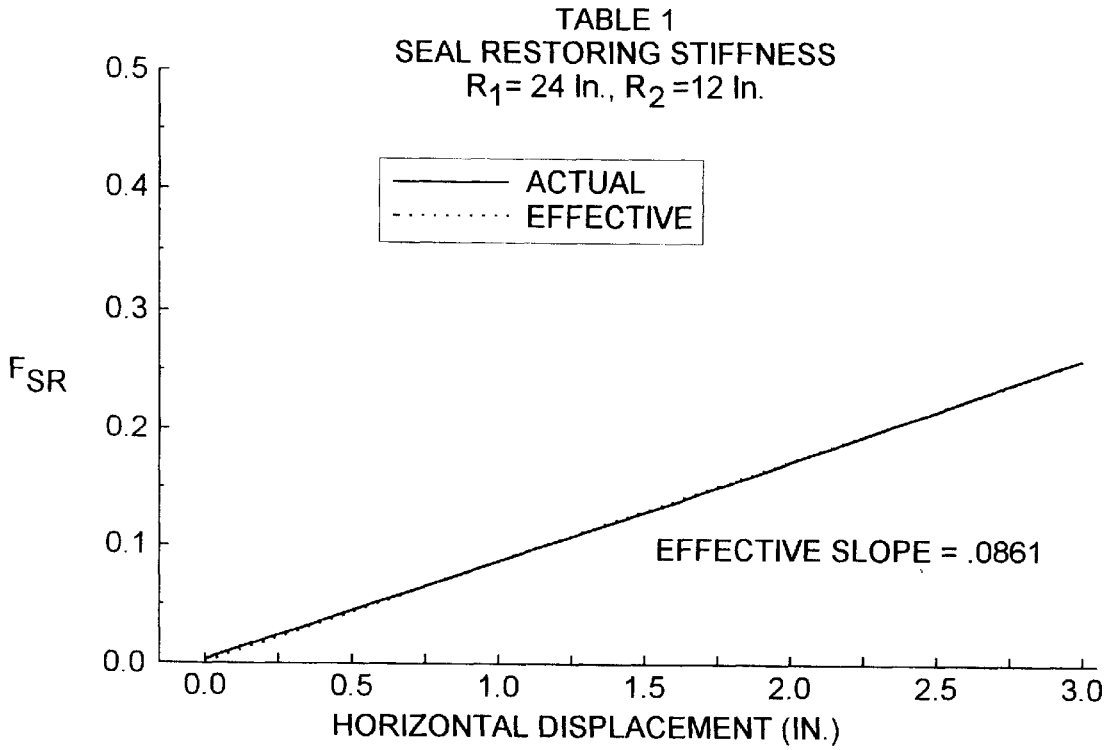
FIG. 9A is a graphical plot showing an example of the restoring stiffness of a shock damper in accordance with the present invention which results from the differences in radii of the rocker and rocker seat thereof, in those embodiments and which a curved rocker and rocker seat are employed.

Table 1 (see FIG. 9A) is a plot of the above equation where: $R_1$=24 inches, and $R_2$=12 inches.

The above equation is not applicable if the indentation 144 of the friction rocker seat 140 is flat or not used, i.e. the inner bottom surface 142 of the friction rocker seat 140 forms the entire upper surface of the friction rocker seat 140. In this case $F_{SR}$ is equal to zero. Additionally, the hemispherically curved bearing surface 90 of the friction rocker 80 would also be approximately flat, and the annular hemispherically curved edge surface 88 of the friction rocker 80 could be flat or curved. It is preferable, in this embodiment, that the edge surface have some radius to prevent the lower end 86 of friction rocker 80 from damaging the surface on which it is resting. This surface could be either the inner bottom surface 142 of the friction rocker seat 140 or the inner bottom surface 30 of the female receptacle 20.

The total side/realigning force generated ($F_S$) is found from the following equation:

$$F_S = F_{SR} + F_{SI}$$

Where:

$F_{SI}$=the side/realigning force generated by the shock insert 60.

Figure 9B:
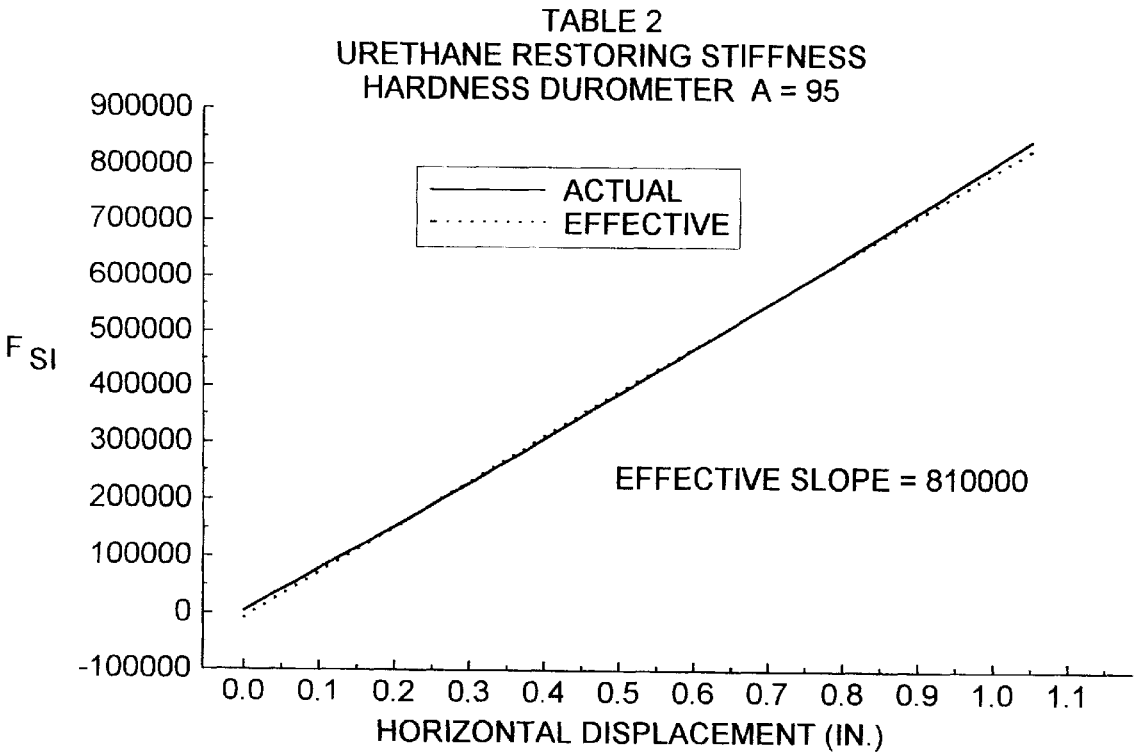
FIG. 9B is a graphical plot showing an example of the restoring stiffness of a shock damper in accordance with the present invention which results from the hardness of the urethane shock insert thereof.

$F_{SI}$ will be dependant on the material selected for shock insert 60. Table 2 (see FIG. 9B) is an example plot of the $F_{SI}$ generated using a urethane having a hardness durometer of 95. $F_S$ is one of the parameters that will be provided by the bridge/structural engineer in the specifications.

Figure 5:
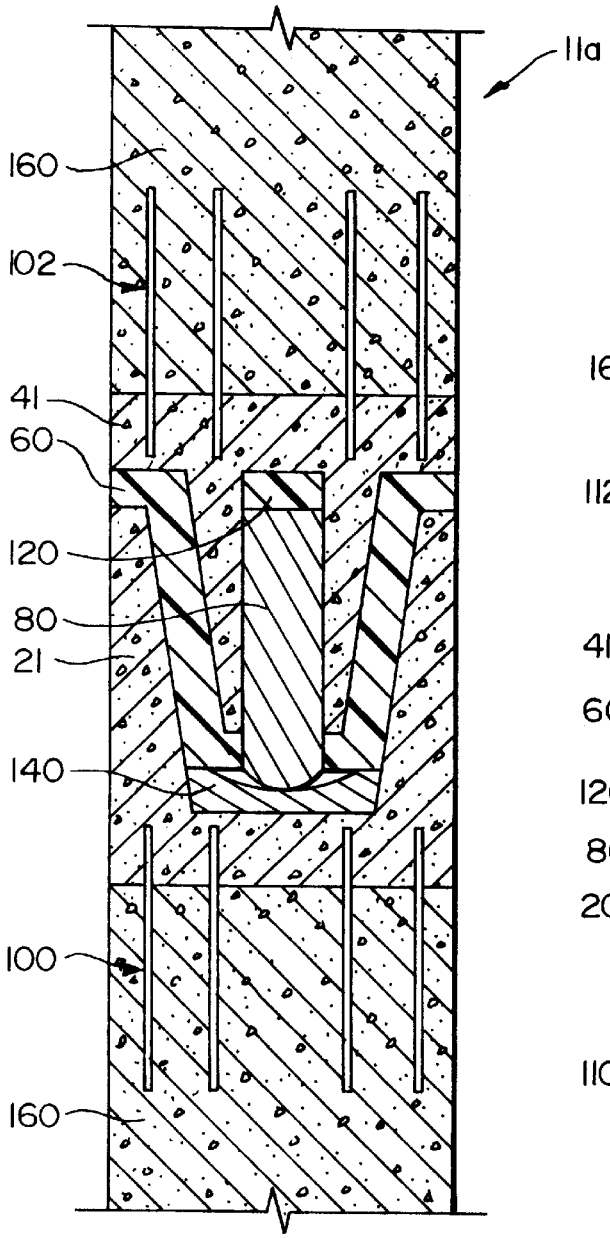
FIG. 5 is a vertical cross section taken through the earthquake shock damper of FIG. 4, showing this shock damper installed in a pillar as part of the original construction thereof.
Figure 6:
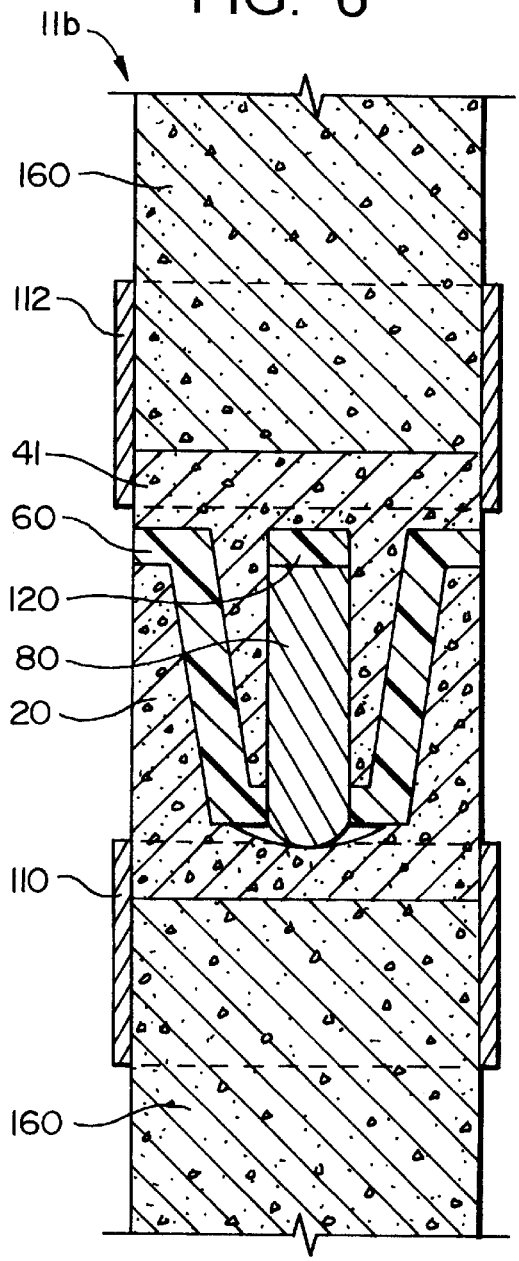
FIG. 6 is a vertical cross-section taken through the earthquake shock damper of FIG. 4, showing this shock damper retrofitted to an existing pillar.

FIG. 5, is a vertical cross-section of the earthquake shock damper of FIG. 4, showing the shock damper 11*a* installed during the initial construction of a reinforced concrete column. In contrast, FIG. 6, shows a vertical cross-section of an embodiment of the earthquake shock damper 11*b* in which there is a collar 110 and a collar 112 for attaching the shock damper 11*b* to an existing column or pillar as retrofitted earthquake protection and showing the absence of the friction rocker seat 140. The retrofit shock damper 11*b* is installed by 1) supporting the structure so as to remove the load from the column or pillar being worked, 2) cutting out or removing a section of the column or pillar just large enough to install the shock damper 11*b* without the collars 110 and 112, 3) installing two collars 110 and 112, one for each end of the cut column or pillar, 4) inserting the shock damper 11*b* into the space in the column/pillar, 5) attaching the collar 110 to the female receptacle and the collar 112 to the male plug, and 6) attaching the collars 110 and 112 to the column/pillar. The collars 110 and 112 are preferably attached to shock damper 11*b* by either a plurality of threaded fasteners or by welding. The collars 110 and 112 are attached to the column by any suitable means compatible with the materials used in the column and the collars 110 and 112.

b. Operation

The earthquake dampers constructed in accordance with this invention dampen the magnitude and lower the frequencies of the earthquake forces transmitted through the shock damper. Both of these effects are principally the result of the following; 1) the capability of the shock insert to flow around the male plug in allowing the female receptacle to be horizontally displaced with respect to the male plug in response to the forces imposed on the shock damper; and 2) the ability of both the shock insert and the shock plug the absorb, filter, and lower the earthquake frequencies transmitted through these shock members. The displacement of the shock insert also allows the shock damper to absorb the forces generated during an earthquake or other disturbing force. The self aligning ability of these shock dampers ensures that the shock damper will continue to function as designed even after repeated earthquake shocks. Additionally, this shock damper will allow the column below the shock damper to fall away in the event this lower portion of the column is damaged. This ability of the shock damper will prevent a falling column from pulling the rest of the supported structure down.

c. Materials/Fabrication

The female receptacle 20 and male plug 40 can be made of any material which has a sufficient strength, and a suitable modulus of elasticity for the specific application. Potential materials include, but are not limited to: iron, steel, aluminum, other metals, and composites such as Kevlar, carbon fiber, S-glass, and E-glass embedded in a epoxy, vinyl-ester, or polyester resin. The preferred material for female receptacle 20 and male plug 40 is corrosion resistant nickel alloyed ductile cast iron of ferrite structure (U.S. Pat. No. 4,702,886 (Kent)). This cast iron has adequate strength and corrosion resistance for most applications. Additionally, this material is relatively inexpensive and easy to work. Both female receptacle 20 and male plug 40 are preferably formed by sand casting. The surfaces in contact with shock insert 60, top edge 22, female conical surface 28, inner bottom 30, bottom edge 46, male conical surface 48, and bottom 50, must have surface finish compatible with the material selected for shock insert 60. The preferred finish for these surfaces is a 250 finish. Some applications, particularly high load applications, may require a smoother finish and/or a coating such as silicone, Teflon, or other lubricating/low friction coating.

Shock insert 60 may be made from any relatively flexible material, which has a suitable stress strain curve, and sufficient viscosity for a particular application. The preferred material for shock insert 60 is urethane (polyurethane) having the appropriate durometer for the specific application. Shock insert 60 is a preferably formed by supporting the male plug 40 in the female receptacle 20, with a specific distance between the male plug 40 and female receptacle 20. This distance is determined by the finished thickness of the shock insert 60 plus an additional amount to account for the expected shrinkage of the urethane (polyurethane) during its cure. The proper durometer Urethane is mixed and then poured into the space between the female receptacle 20 and the male plug 40. When the urethane has cured the male plug 40 no longer needs to be supported. When constructing the shock damper 11 shown in FIG. 4 a urethane washer is first laid in the space between the plug bottom 50 of the male plug 41 and the inner bottom 142 of the friction rocker seat 140 or the inner bottom 30 of the female receptacle 20 and around the friction rocker 80. This washer prevents urethane from flowing into an air space 150 (FIG. 4). If urethane were to flow into the air space 150 there is a possibility that the urethane could affect the operation of friction rocker 80. In some applications this possible effect may be allowed/tolerated, thus the urethane washer would not be used. This washer will become an integral part of shock insert 60 when the remaining urethane is poured.

The friction rocker 80 may be made from any material having sufficient strength and hardness (see list above for female receptacle 20 and male plug 40). The preferred material is ASTM A 325, Type 3, Grade B high strength low alloy corrosion resistant steel with the lower end portion 86 of friction rocker 80 hardened to 60–65 rockwell. Additionally, it is preferred that the friction rocker 80 be compatible with the materials selected for the male receptacle 41 and friction rocker seat 140, such that galvanic corrosion or other corrosion types should not occur. Furthermore, in some applications the use of friction reducing coatings such as Teflon or silicon may be desired to enhance the performance or required to obtain proper performance of the shock damper 11.

The friction rocker seat 140 may be made from any material having sufficient strength and hardness (see above list for female receptacle 20 and male plug 40). The preferred material is a tool steel hardened to 90–95 rockwell and compatible with friction rocker 80. It is preferred that the friction rocker seat 140 be harder than the friction rocker 80 to insure that the shock damper functions properly. Additionally, in some applications the inner bottom surface 142 and indentation 144 may be coated with friction reducing coatings such as Teflon or silicon. These coatings may be desired to enhance the performance or required to obtain proper performance of the shock damper.

d. Sliding Shoe Embodiment

Figure 7:
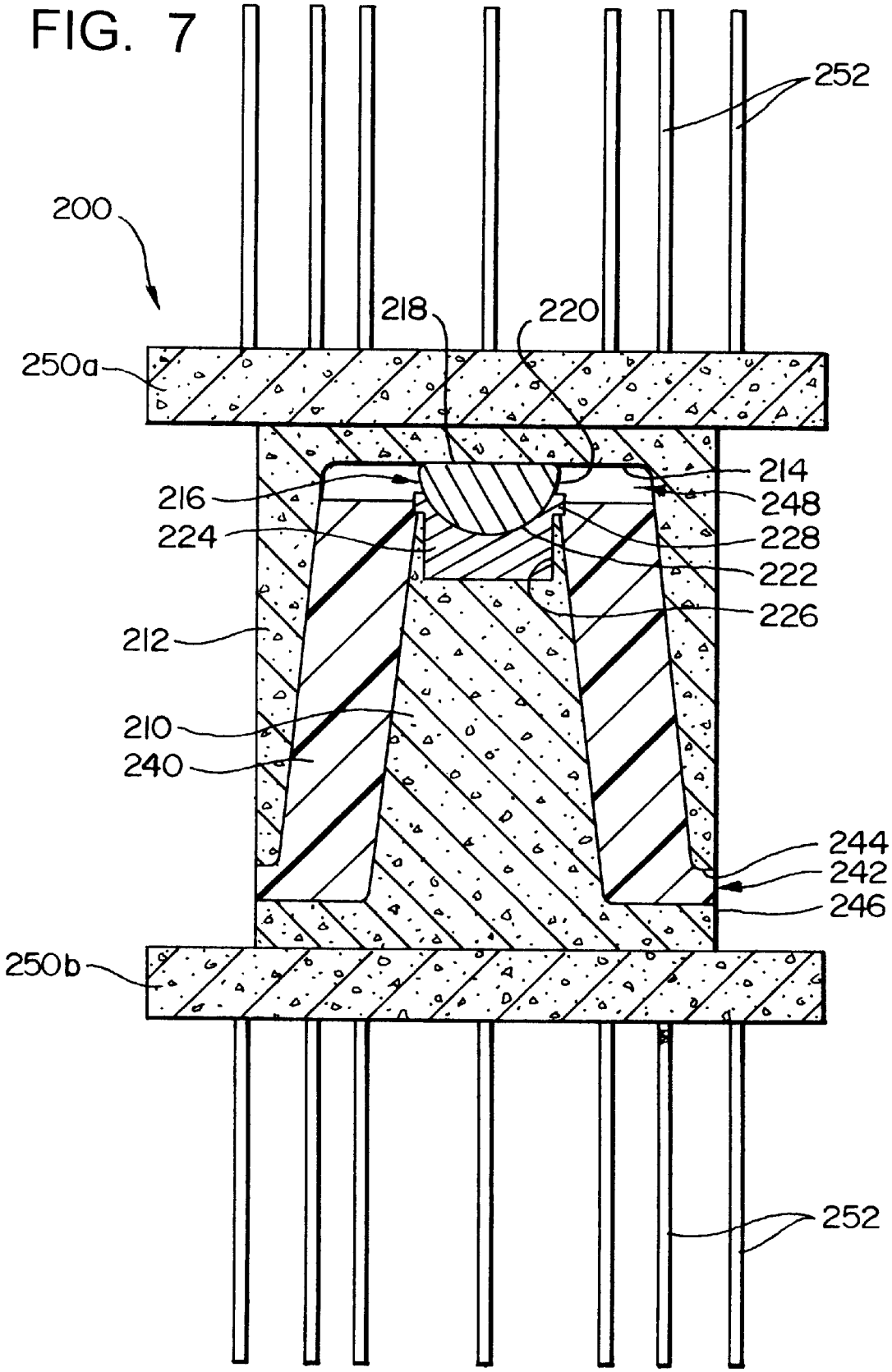
FIG. 7 is a vertical cross section taken through earthquake shock damper in accordance with another embodiment of the present invention, in which the friction interface for providing vertical load transfer between the male and female members is provided by a sliding shoe which is configured for rocking motion within a hemispherical socket.
Figure 8:
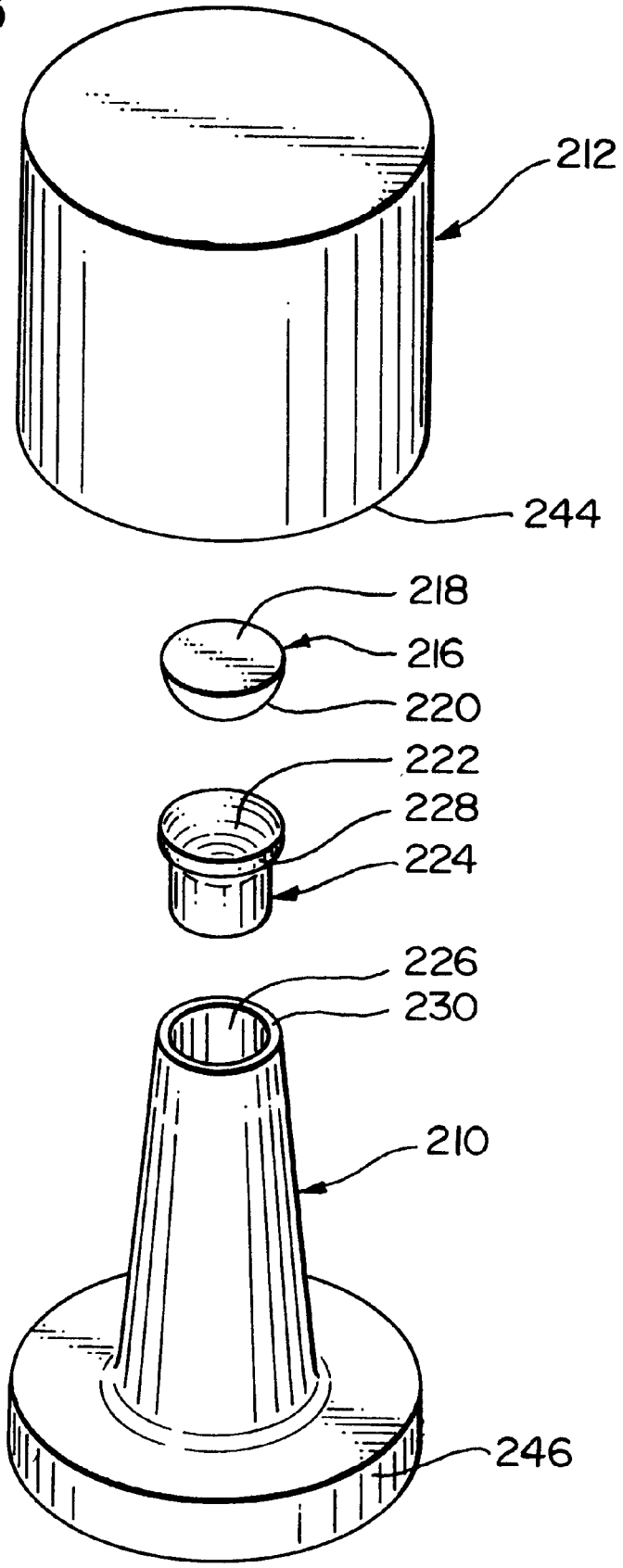
FIG. 8 is an exploded perspective view showing the male part and female socket of the shock damper of FIG. 7, and the sliding shoe and socket member which fit into the tip of the male plug member.

FIGS. 7–8 show a shock damper assembly 200 which is somewhat similar to that shown in FIGS. 4–5, in that there is a friction interface for transferring a portion of the vertical loads between the male and female members of the assembly. In this instance, however, there is a flat, planar interface between the two members (as opposed to the large indentation in the rocker seat described above) and the shoe itself is mounted for rocking motion in a comparatively small hemispherical socket.

Accordingly, as can be seen in FIG. 7, there is a male plug member 210 and a female receptacle member 212 which correspond generally to the male and female members described above. It will be noted that in FIGS. 7–8 these are shown in an inverted orientation as compared with the views in FIGS. 1–6, this simply being a matter of design choice.

The interior of the female receptacle member 212 is provided with a substantially flat, planar base surface 214 which is aligned in a generally horizontal direction. The upper end of the male plug member 210, in turn, is fitted with a sliding shoe member 216 having a flat, substantially planar upper surface 218 which slidingly abuts the base surface 214 of the receptacle. As can also be seen in FIG. 8, the shoe member has a hemispherical lower surface 220 which is received within a corresponding hemispherical socket 222 in a bearing cup 224, which in turn is mounted in an opening 226 in the tapered upper end of the male plug member. An annular load-bearing shoulder 228 on cup 224 engages a corresponding lip 230 on the plug member to distribute the load to the end of the plug member. The use of a separate bearing cup 224 to support the shoe member permits this to be fabricated of high-strength tool steel without having to make the entire plug member of this material, which would be prohibitively expensive.

Finally, the urethane shock insert 240 is formed between the plug 210 and the receptacle 212, in essentially the same matter as described above. As can be seen in FIG. 7, the height of the male plug member, including the sliding shoe assembly at its tip, is preferably sufficient that a vertical gap 242 is formed between the lip 244 of the receptacle and the base 246 of the plug, which is filled by the flexible material of the insert so as to permit unobstructed movement between these members as deformation of the insert occurs. As has been described above, the insert may suitably be a flexible urethane insert which is flowed between the members. However, the bottom of the receptacle is preferably kept free of the urethane or other insert material, so as to form a pocket 248 which permits the shoe member to slide freely over the base surface 214.

In the embodiment which is illustrated, the male plug member and the female receptacle member are mounted to base flanges 250*a,* 250*b* from which reinforcement rods 252 extend for mounting the shock damper assembly in a column or similar structure. As has been described above, however, other suitable mounting means may be employed in addition to or in place of the rod members; for example, the base flanges 250*a,* 250*b* which are shown in FIG. 7 can be bolted or otherwise mounted to corresponding flanges (not shown) which are attached by sleeves or other means to the ends of the column sections.

In the event of an earthquake, operation of the shock damper assembly is generally similar to that of the assembly shown in FIGS. 4–5, with the shock insert flowing around the male plug so as to allow the female receptacle to be horizontally displaced with respect to the plug. In the embodiment which is shown in FIG. 7, however, side-to-side motion is permitted by the sliding engagement of the flat bearing surfaces on the shoe member and the female receptacle, while the hemispherical bearing surfaces 220, 222 permit the shoe to tilt and rock so as to accommodate changes in axial alignment between the upper and the lower parts of the column, as indicated by the arrows in FIG. 7. Also, while the embodiment which is shown in FIGS. 7–8 is particularly configured for use in areas which are subject to rolling-type earthquakes, a shock insert/plug substantially similar to that which has been described above (see shock plug 120) may be incorporated under the shoe/cup assembly 216,224 to provide additional damping/absorption of earthquake forces, especially in the vertical direction.

Design considerations, alternative component configurations, and materials selections for the embodiment shown in FIGS. 7–8 are substantially similar to those described above. It will be noted, however, that it is particularly desirable in this embodiment to have the bearing surfaces of the hemispherical shoe 216 and the cup 224 formed of a high strength material (such as the ASTM A 325 Type 3, Grade B high-strength hardened steel described above), and that at least the shoe member be coated with a suitable low-friction and/or lubricating material such Teflon or silicon so as to enhance the performance of the assembly. It will also be noted that the because the sliding bearing surfaces of the embodiment which is shown in FIGS. 7–8 are all substantially flat or hemispherical, machining costs are minimized. Still further, the amount of low-friction/lubricating coating material can be minimized, if desired, by applying it only to the surfaces of the hemispherical sliding shoe member.

d. Design

Each shock damper must be designed to meet the specifications imposed by the structural engineer designing the bridge/structure. The engineer will provide the following: a) number of pillars/columns used to support the structure, b) the geometry of the pillar/column, c) the transverse isotropic material properties of the column, d) the stiffness required of the shock damper, e) the anticipated location of the shock damper, f) the amount of maximum horizontal deflection desired, and g) the horizontal and vertical design load for each column. The design of the shock damper is verified by using a finite element analysis program such as MARC ANALYSIS™. The following information is input into the program: a) the geometry of each piece of the shock damper, b) the modulus of elasticity (E), and Poisson's ratio (υ) for the relativity rigid components such as the female receptacle 20 or 21, the male plug 40 or 41, the friction rocker 80 (shown in FIG. 4), the friction rocker seat 140 (shown in FIG. 4) and the collar 110 and 112 (shown in FIG. 6), c) the stress strain curve and/or the viscosity and/or the durometer of the material selected for shock insert 60, d) the information provided by the bridge engineer (note not all of the information provided by the bridge engineer will be relevant for each analysis of each component, and an engineer familiar with the finite element analysis program will know which information is needed), and e) the boundary conditions. The finite element program can provide the following information: a) the stress on each component, b) the amount of relative movement between the female receptacle 20/21 and male plug 40/41, and the deformation of the shock insert 60. This design evaluation is an iterative process and must be repeated as changes are made to optimize the design for a particular applications. The typical design should be able to be finalized after as few as 10 runs through the finite element analysis program. After each data run the engineer must insure that the materials selected have the material properties required for the particular application within shock damper.

This sock damper can be installed at any point in a load bearing column. Typically, the shock damper will be installed at the zero moment point in the column. The specific location, however, will be determined by the structural/bridge engineer's analysis.

What is claimed is:

1. An earthquake shock damper for protecting a load bearing column or pillar and a structure which is supported thereby from failure during an earthquake, said shock damper comprising:

a) a female receptacle having a top edge, a bottom surface, and a female surface connecting said top edge to said bottom surface;

b) a male plug having a bottom edge, an end surface, and a male surface connecting said bottom edge to said end surface;

c) means for attachment of said female receptacle to said column or pillar;

d) means for attachment of said male plug to said column or pillar;

e) a shock insert separating said female receptacle and said male plug; and f) bearing means for transmitting loads in a generally vertical direction between said plug and said receptacle, said bearing means comprising:

a first bearing surface on said end surface of said male plug; and a second bearing surface on said bottom surface of said female receptacle for bearing against said first bearing surface in sliding engagement therewith, said second bearing surface being a generally flat, horizontal bearing surface formed on said bottom surface of said receptacle, and said first bearing surface comprising:

a generally flat bearing surface formed on said end surface of said male plug for forming a flat load bearing interface against said second bearing surface; and means for enabling said first bearing surface to tilt on said plug, so that said flat, load-bearing interface is maintained during relative movement of said male plug and female receptacle.

2. The shock damper of claim 1, wherein said first bearing surface comprises:

a shoe member mounted to said end surface of said male plug and having said first bearing surface formed on a first side thereof.

3. The shock damper of claim 2, wherein said means for enabling said first bearing surface to tilt on said male plug comprises:

means for pivotally mounting said shoe member to a tip end of said plug so that said first bearing surface thereon rests in flat abutment against said second bearing surface on said receptacle.

4. The shock damper of claim 3, wherein said means for pivotally mounting said shoe member to said tip end of said plug comprises:

a first substantially hemispherical bearing surface formed on a second side of said shoe member; and a second substantially hemispherical bearing surface formed on said tip end of said plug for mating with said first substantially hemispherical surface so as to permit said shoe member to tilt on said tip end of said plug.

5. The shock damper of claim 4, wherein said first substantially hemispherical bearing surface is a convexly curved dome surface on said second side of said shoe member, and said second substantially hemispherical bearing surface is a concavely curved cup surface on said tip end of said plug.

6. An earthquake shock damper for protecting a vertically extending, load bearing column or pillar and a structure which is supported thereby from failure during an earthquake, said shock damper comprising:

a) a female receptacle having inner and bottom surfaces;

b) a male plug disposed generally vertically in said female receptacle and having exterior and end surfaces;

c) a yieldable shock insert mounted intermediate said male plug and female receptacle so as to substantially separate said surfaces thereof; and d) means for transmitting loads in a generally vertical direction between said male plug and said female receptacle while enabling said plug and receptacle to tilt relative to one another so as to accommodate changes in axial alignment between said male plug and female receptacle which result from earthquake forces.

7. The earthquake shock damper of claim 6, wherein said means for transmitting loads in a generally vertical direction while permitting said plug and receptacle to tilt relative to one another comprises:

a base portion of said yieldable shock insert which extends intermediate said end surface of said plug and said bottom surface of said receptacle, so as to form a layer which yieldingly deforms as said end surface of said plug tilts relative to said bottom surface of said receptacle.

8. The shock damper of claim 7, wherein said shock insert comprises:

an insert formed of flexibly yielding urethane material.

9. The shock damper of claim 6, wherein said means for transmitting loads in a generally vertical direction while permitting said plug and receptacle to tilt relative to one another comprises:

a first bearing surface on said end surface of said male plug;

a second bearing surface on said bottom surface of said female receptacle for forming a load bearing interface against said first bearing surface in sliding engagement therewith; and means for enabling said first bearing surface to tilt on said male plug so that said load bearing interface is maintained during relative movement of said male plug and female receptacle.

10. The shock damper of claim 9, wherein first bearing surface on said male plug comprises:

a substantially flat bearing surface for forming a substantially flat load bearing interface against said second bearing surface on said female receptacle.

11. The shock damper of claim 10, wherein said means for enabling said first bearing surface to tilt on said male plug comprises:

a shoe member having said first bearing surface formed on a first side thereof; and means for pivotally mounting said shoe member to an end of said male plug so that said first bearing surface thereon rests in flat abutment against said second bearing surface on said female receptacle.

12. The shock damper of claim 11, wherein said means for pivotally mounting said shoe member to said end of said male plug comprises:

a first substantially hemispherical bearing surface formed on a second side of said shoe member; and a second substantially hemispherical bearing surface formed on said end of said male plug for mating with said first hemispherical bearing surface so as to permit said shoe member to tilt on said end of said male plug.

13. The shock damper of claim 12, wherein said first hemispherical bearing surface comprises a convexly curved dome surface on said second side of said shoe member, and said second hemispherical bearing surface comprises a concavely curved cup surface on said end of said male plug.

14. The shock damper of claim 6, wherein said means for transmitting loads in a generally vertical direction while permitting said plug and receptacle to tilt relative to one another comprises:

a first curved bearing surface on said end surface of said male plug; and a second curved bearing surface on said bottom surface of said female receptacle, for forming a curved load bearing interface against said first curved bearing surface in sliding engagement therewith.

15. The shock damper of claim 14, wherein said first curved bearing surface comprises a convexly curved dome portion on said end surface of said male plug, and said second curved bearing surface comprises a concavely curved dish portion on said bottom surface of said female receptacle.

16. The shock damper of claim 15, further comprising:

a shock absorbing member mounted intermediate said first curved bearing surface and said end of said male plug for absorbing generally vertical shock loads between said male plug and said female receptacle.

17. The shock damper of claim 16, wherein said shock absorbing member comprises:

a resiliently yielding plug member connecting said first curved bearing surface to said end of said male plug.

18. An earthquake shock damper for protecting a vertically extending, load bearing column or pillar and a structure which is supported thereby from failure during an earthquake, said shock damper comprising:

a) a female receptacle having inner and bottom surfaces, said bottom surface comprising a first, generally flat bearing surface;

b) a male plug disposed generally vertically in said female receptacle;

c) a shoe member on an end of said male plug, said shoe member having a second, generally flat bearing surface for forming a substantially flat load bearing interface against said first bearing surface on said female receptacle;

d) a yieldable shock insert mounted intermediate said male plug and said female receptacle; and e) means for pivotally mounting said shoe member to said male plug so that said second bearing surface thereon remains in flat abutment with said first bearing surface on said female receptacle so as to transmit loads in a generally vertical direction between said plug and receptacle as said plug and receptacle tilt relative to one another as a result of earthquake forces.

* * * * *